United States Patent [19]

Higby et al.

[11] Patent Number: 4,850,910

[45] Date of Patent: Jul. 25, 1989

[54] COUNTER-ROTATION TRANSMISSION

[75] Inventors: Jeffery P. Higby, Waukegan; Kennedy K. McElroy, Jr., Lindenhurst; Arthur R. Ferguson, Waukegan; Gerald F. Bland, Glenview, all of Ill.; Michael W. Freitag, Kenosha, Wis.; Donald K. Sullivan, Prospect Heights, Ill.

[73] Assignee: Outboard Marine Corporation, Waukegan, Ill.

[21] Appl. No.: 55,733

[22] Filed: May 29, 1987

[51] Int. Cl.[4] ..... B63H 21/28

[52] U.S. Cl. ..... 440/75

[58] Field of Search ..... 440/75, 78, 83, 86, 440/900; 74/378; 192/21, 48, 91; 308/174, 175, 232, 234

[56] References Cited

U.S. PATENT DOCUMENTS

| | | | |
|---|---|---|---|
| 3,217,688 | 11/1965 | Warburton et al. | 440/75 |
| 3,727,574 | 4/1973 | Bagge | 440/75 |
| 4,302,196 | 11/1981 | Blanchard | 440/75 |
| 4,637,802 | 1/1987 | Taguchi et al. | 440/75 |
| 4,689,027 | 8/1987 | Harada et al. | 440/83 |

FOREIGN PATENT DOCUMENTS

| | | | |
|---|---|---|---|
| 175346 | 8/1986 | Japan | 440/75 |

*Primary Examiner*—Joseph F. Peters, Jr.
*Assistant Examiner*—Jesûs D. Sotelo
*Attorney, Agent, or Firm*—Michael, Best & Friedirch

[57] ABSTRACT

Disclosed herein is a marine propulsion device comprising a lower unit including a gearcase, a driveshaft having an end extending into the gearcase, a pinion mounted on the end of the driveshaft, a propeller shaft bearing housing located within the gearcase having a forward end adjacent the pinion, a propeller shaft rotatably mounted in the propeller shaft bearing housing and having a rear end portion and a portion forwardly of the rear end portion, a propeller mounted on the rear end of the propeller shaft, a bevel gear adjacent the forward end of the propeller shaft bearing housing and engaging the pinion, the bevel gear including an annular forwardly facing thrust transferring surface, and an annular thrust transferring element mounted on the propeller shaft bearing housing and engageable with the annular forwardly facing thrust transferring surface so as to transfer thrust forwardly from the bevel gear through the thrust transferring element and to the propeller shaft bearing housing.

47 Claims, 2 Drawing Sheets

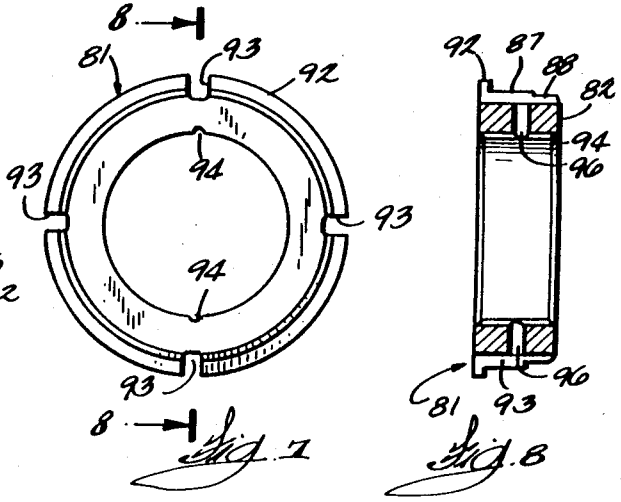
Fig. 8
Fig. 7
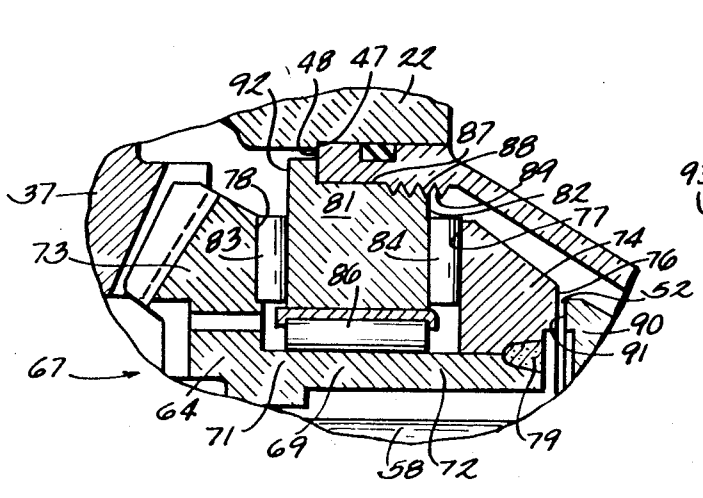
Fig. 6
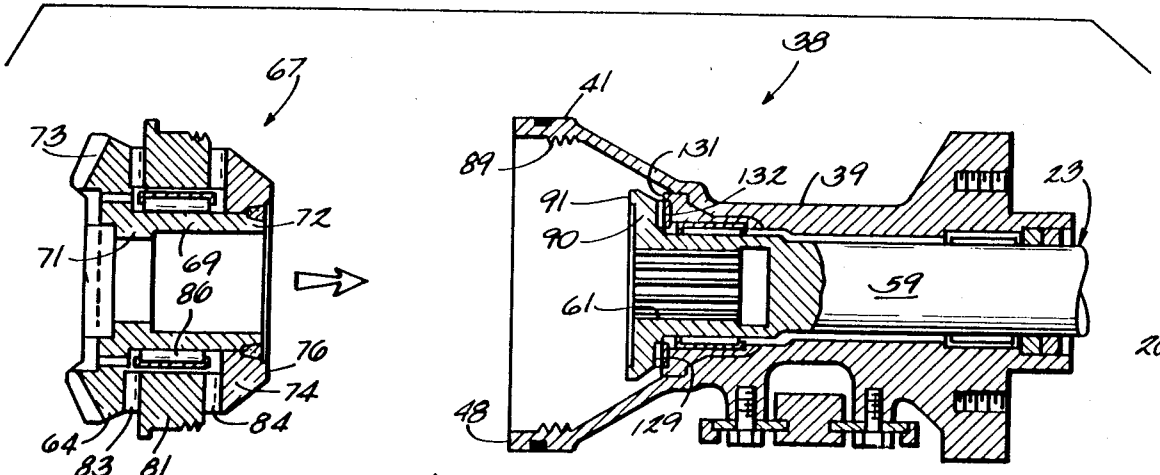
Fig. 5
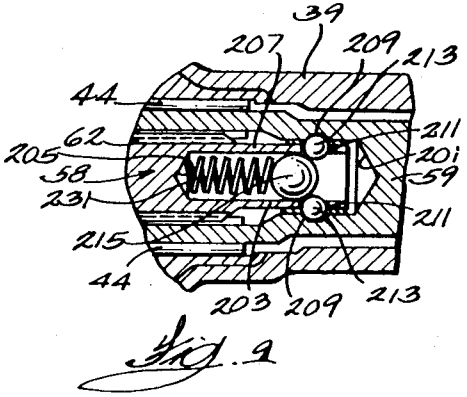
Fig. 9

COUNTER-ROTATION TRANSMISSION

BACKGROUND OF THE INVENTION

This invention relates generally to marine propulsion devices such as outboard motors and stern drive units, and, more particularly, to transmissions for marine propulsion devices and means therein for receiving propeller shaft thrust.

In the marine art, it is known to mount two marine propulsion devices, such as outboard motors or stern drive units, in side-by-side relation on the transom of a boat. With such installations, undesired steering torque generated by the propellers can be reduced, and overall boat handling improved, through the use of counter-rotating propeller shafts, i.e., propeller shafts that rotate in opposite directions.

It is desirable to construct the gearcases in the lower units of dual installation marine propulsion devices so that both engines can rotate in the same direction, while the propeller shaft of one of the devices is driven in one direction and the propeller shaft of the other device is driven in the opposite direction, and without requiring extensive structural modification of the lower units or gearcases. In marine propulsion devices wherein forward and rearward bevel gears are simultaneously driven by a common pinion, and are selectively coupled to the propeller shaft so as to selectively provide forward and reverse thrust operation, counter-rotation can be implemented by adapting the rearward, rather than the forward, bevel gear to drive the propeller shaft during forward operation of the marine propulsion device. This generally requires that structure other than the forward bevel gear be provided for transferring forward thrust from the propeller to the marine propulsion device.

Attention is directed to the following U.S. and foreign patent documents:

| | | |
|---|---|---|
| Taguchi et al. | U.S. Pat. No. 4,637,802 | Jan. 20, 1987 |
| Bagge | U.S. Pat. No. 3,727,574 | April 17, 1973 |
| Blanchard | U.S. Pat. No. 4,302,196 | Nov. 24, 1981 |
| Harada et al. | Japan No. 61-175346 | August 7, 1986 |

SUMMARY OF THE INVENTION

The invention provides a gear assembly comprising a bevel gear including a generally cylindrical body portion having a first end and a second end, which bevel gear also includes a bevel gear portion at the first end and an annular flange at the second end, and further comprising a substantially annular member encircling the cylindrical body portion between the bevel gear portion and the annular flange and permitting rotation of the bevel gear relative to the annular member.

The invention also provides a bearing assembly for use in a marine propulsion device, the bearing assembly comprising a bevel gear including a generally cylindrical body portion having a first end and a second end, which bevel gear also includes a bevel gear portion adjacent the first end and an annular flange adjacent the second end, a substantially annular collar encircling the cylindrical body portion between the bevel gear portion and the annular flange and adapted to permit rotation of the bevel gear relative to the annular collar, a bearing housing having a forward end including an open end dimensioned to receive therein the annular collar and the annular flange, and thrust transfer means for transferring forwardly directed thrust from the annular collar to the forwrad end of the bearing housing.

The invention also provides a bearing assembly for use in a marine propulsion device, the bearing assembly comprising a bevel gear including a generally cylindrical body portion having a first end and a second end, which bevel gear also includes a bevel gear portion adjacent the first end and including a radially extending bearing surface facing toward the second end, and which bevel gear also includes an annular flange adjacent the second end and including a radially extending bearing surface facing toward the first end, a substantially annular member encircling the cylindrical body portion between the bevel gear portion and the annular flange and adapted to permit rotation of the bevel gear relative to the annular member, which annular member includes end bearing faces in facing relation to the bearing surfaces of the bevel gear, and an inner bearing surface in telescopic relation to the cylindrical portion, bearings between the end bearing faces and the bearing surfaces, an other bearing between the inner bearing surface and the cylindrical portion, and a bearing housing having a forward end including a cavity dimensioned to receive therein the annular member and the annular flange.

The invention also provides a marine propulsion device comprising a lower unit gear case, a propeller shaft section rotatably supported in the lower unit gear case, a propeller supported on the propeller shaft section, a forward shaft section supported in the lower unit gear case for rotation in co-axial relation to and forwardly of the propeller shaft section, means connecting the forward shaft section and the propeller shaft section for common rotation, and means for releasably retaining the forward shaft section in axial predetermined relation to the propeller shaft section.

The invention also provides a marine propulsion device comprising a lower unit including a gearcase, a propeller shaft bearing housing located within the gearcase, a propeller shaft rotatably mounted in the propeller shaft bearing housing, and means for transmitting forward thrust from the propeller shaft to the gearcase through the propeller shaft bearing housing.

The invention also provides a marine propulsion device comprising a lower unit including a gearcase having a forwardly located end and a rearwardly located end, a rotatable pinion located within the gearcase, a propeller shaft rotatably mounted within the gearcase, a rearwardly located gear in meshing engagement with the pinion and selectively engagable with the propeller shaft, and means for transmitting forward thrust from the propeller shaft to the gearcase through the rearwardly located gear.

The invention also provides a bevel gear comprising a generally cylindrical body portion having a forward end and a rearward end, a bevel gear portion located at the forward end, and a radially outwardly extending flange formed at the rearward end.

The invention also provides a marine propulsion device comprising a lower unit including a gearcase, a driveshaft having an end extending into the gearcase, a pinion mounted on the end of the driveshaft, a propeller shaft bearing housing located within the gearcase and having a forward end adjacent the pinion, a propeller shaft rotatably mounted in the propeller shaft bearing housing and having a flange for transmitting forward thrust, a propeller mounted on the propeller shaft, a bevel gear adjacent the forward end of the propeller shaft bearing housing and in meshing engagement with the pinion, which bevel gear includes an annular rearwardly facing thrust receiving surface engageable with the propeller shaft flange for receiving forward thrust therefrom, and an annular forwardly facing thrust transferring surface for transmitting forward thrust to the lower unit.

The invention also provides a marine propulsion device comprising a lower unit including a gearcase, a drive shaft having an end extending into the gearcase, a pinion mounted on the end of the drive shaft, a propeller shaft bearing housing located within the gearcase and having a forward end adjacent the pinion, a propeller shaft rotatably mounted in the propeller shaft bearing housing and having a rear end portion and a portion forwardly of the rear end portion and further having a flange between the rear end portion and the forward portion, and a bevel gear adjacent the forward end of the propeller shaft bearing housing and engaging the pinion, the bevel gear including a cylindrical portion and a rearwardly located flange extending radially outwardly from the cylindrical portion for receiving thrust from the propeller shaft flange.

The invention also provides a marine propulsion device comprising a lower unit including a gearcase, a drive shaft having an end extending into the gearcase, a pinion mounted on the end of the drive shaft, a propeller shaft bearing housing located within the gearcase and having a forward end adjacent the pinion, a propeller shaft rotatably mounted in the propeller shaft bearing housing and including a rear end portion, a portion forwardly of the rear end portion, and a flange on the rear end portion adjacent the forward portion, a bevel gear adjacent the forward end of the propeller shaft bearing housing and engaging the pinion, the bevel gear including a cylindrical portion and a rearwardly located flange extending radially outwardly from the cylindrical portion, the rearwardly located flange including a rearwardly facing surface engageable with the flange of the propeller shaft and including a forwardly facing thrust transferring surface, and an annular thrust transferring element mounted on the propeller shaft bearing housing and adapted to receive thrust from the annular forwardly facing thrust transferring surface and to transfer thrust forwardly from the flange of the propeller shaft through the bevel gear and the annular thrust transferring element to the propeller shaft bearing housing.

The invention also provides a marine propulsion device comprising a lower unit including a gearcase, a drive shaft having an end extending into the gearcase, a pinion mounted on the end of the drive shaft, a propeller shaft bearing housing located within the gearcase and having a forward end adjacent the pinion, means for transferring forward thrust from the propeller shaft bearing housing to the gearcase, a propeller shaft rotatably mounted in the propeller shaft bearing housing and including a rear end portion, a portion forwardly of the rear end portion, and a flange on the rear end portion adjacent the forward portion, a propeller mounted on the rear end portion of the propeller shaft, a bevel gear adjacent the forward end of the propeller shaft bearing housing and engaging the pinion, the bevel gear including a cylindrical portion and a rearwardly located flange extending radially outwardly from the cylindrical portion, the rearwardly located flange including a rearwardly facing surface engageable with the flange of the propeller shaft and including an annular forwardly facing thrust transferring surface, and an annular thrust transferring element mounted on the propeller shaft bearing housing and engageable with the annular forwardly facing thrust transferring surface so as to transfer thrust forwardly from the propeller shaft through the bevel gear, the annular thrust transferring element, and the propeller shaft bearing housing to the gearcase.

The invention also provides a marine propulsion device comprising a lower unit including, at the bottom thereof, a gear case, a power transmitting shaft supported in the gear case for rotation about a horizontal axis and including therein an axial bore having a forwardly located open end, a shifter housing supported in the gear case and having a central aperature generally co-axial with the horizontal axis and having a vertical passage located in laterally spaced relation to said horizontal axis, a shifter shaft located in the bore, extending forwardly of the bearing housing, and being movable axially in the bore between a neutral position and a drive position, a shift rod supported by the lower unit for vertical movement therein and including a main portion in generally co-planar relation to said horizontal axis and having a lower end, which shift rod also includes a lower portion having a horizontal leg fixed to the lower end of the main portion and a vertical leg extending in laterally spaced relation to the horizontal axis and with a lower end received in the passage in the bearing housing, a bell crank supported in the lower unit for pivotal movement about a horizontal axis located forwardly of the shift rod and above the horizontal axis and including a rearwardly projecting arm and a downwardly projecting arm, means connecting the downwardly projecting arm and the shifter shaft at a location forwardly of the bearing housing for affording rotation of the shifter shaft relative to the bell crank and for axially moving the shifter shaft in response to pivotal movement of the bell crank, and means connecting the rearwardly projecting arm of the bell crank with the shift rod for effecting pivotal movement of the bell crank in response to vertical movement of the shift rod.

A principal feature of the invention is the provision of proper support for a rearwardly located, forward thrust bevel gear in a counter-rotating marine propulsion device.

Another principal feature of the invention is the provision of a marine propulsion device wherein forward thrust is transferred from a propeller shaft to a propeller shaft bearing housing and from the propeller shaft bearing housing to the housing of the marine propulsion device.

Another principal feature of the invention is the provision of a counter-rotating marine propulsion device wherein a rearward bevel gear assembly is adapted to transfer forward thrust from a propeller shaft to a propeller shaft bearing housing.

Still another principal feature of the invention is the provision of a rearward bevel gear having a rearwardly located thrust transferring flange for transferring forwardly directed thrust from the rearward bevel gear to a thrust transferring element mounted on a propeller shaft bearing housing.

Various other principal features of the invention will become apparent to those skilled in the art upon review of the following detailed description, claims and drawings.

DESCRIPTION OF THE DRAWINGS

FIG. 5 is an exploded cross-sectional view of a bearing housing assembly as utilized in the counter-rotation transmission shown in FIG. 3.

FIG. 6 is an enlarged, partial, sectional view of a forward thrust, rearwardly located, bevel gear assembly included in the bearing housing assembly shown in FIG. 5.

FIG. 7 is a front elevational view of an annular thrust transferring element utilized in the forward thrust, rearwardly located, bevel gear assembly shown in FIGS. 3, 5 and 6.

FIG. 8 is a cross-sectional view of the annular thrust transferring element shown in FIG. 7 taken along Line 8—8 thereof.

FIG. 9 is a fragmentary view illustrating a portion of a modified construction.

Figures 1, 2, 3, 4:
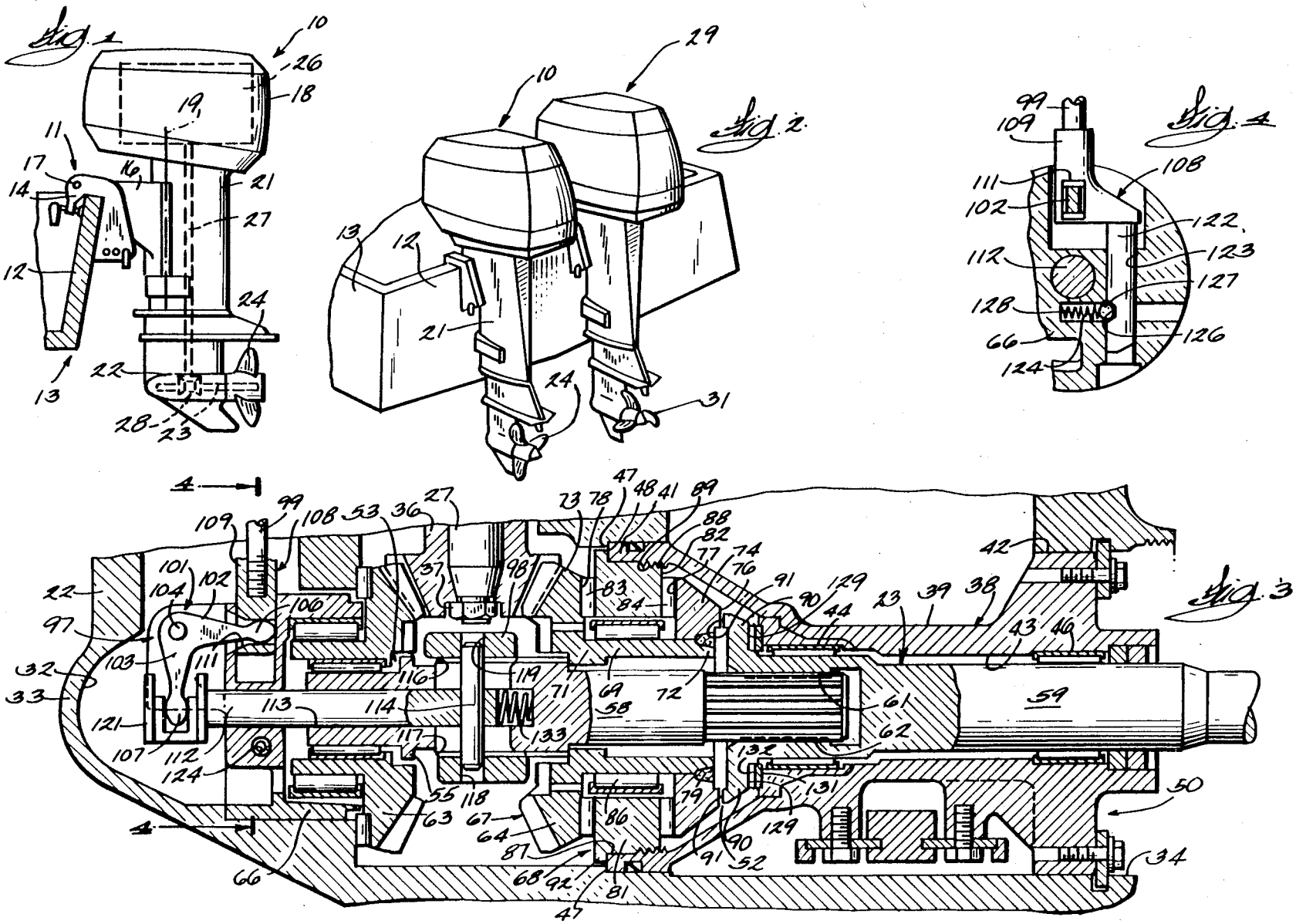
FIG. 1 is a side elevational view of a marine propulsion device which includes a counter-rotation transmission and which embodies various of the features of the invention.
FIG. 2 is a fragmentary perspective view of the transom of a boat having thereon mounted the marine propulsion device shown in FIG. 1 in tandem with another marine propulsion device of conventional construction.
FIG. 3 is an enlarged cross-sectional view of the counter-rotation transmission included in the marine propulsion device shown in FIGS. 1 and 2.
FIG. 4 is a fragmentary cross-sectional view of the counter-rotation transmission shown in FIG. 3 taken along Line 4—4 thereof.

Before one embodiment of the invention is explained in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

DESCRIPTION OF THE PREFERRED EMBODIMENT

A marine propulsion device 10 embodying the invention is illustrated in the drawings. As best shown in FIG. 1, the marine propulsion device 10 comprises a mounting assembly 11 fixedly attached to the transom 12 of a boat 13. While various suitable mounting assemblies can be employed, in the preferred embodiment, the mounting assembly includes a transom bracket 14 fixedly attached to the transom 12, and a swivel bracket 15 mounted on the transom bracket 14 for pivotal movement of the swivel bracket 16 relative to the transom bracket 14 about a generally horizontal tilt axis 17.

The marine propulsion device 10 also comprises a propulsion unit 18 mounted on the swivel bracket 16 for pivotal movement of the propulsion unit 18 relative to the swivel bracket 16 about a generally vertical steering axis 19. The propulsion unit 18 includes a lower unit 21 having a gearcase housing 22, a rotatable propeller shaft 23 extending from the gearcase housing 22, and a propeller 24 mounted on the propeller shaft 23. An internal combustion engine 26 is mounted on the lower unit 21 and is drivingly connected through the propeller shaft 23 to the propeller 24 by means of a drive shaft 27 and a counter-rotation transmission 28 located within the gearcase housing and operable to selectively couple the drive shaft 27 to the propeller shaft 23.

As best shown in FIG. 2, the marine propulsion device 10 is adapted for use as one of a pair of marine propulsion devices 10 and 29 mounted in side-by-side relationship on the transom 12 of the boat 13. The right hand, or starboard, device 29 can comprise a conventional marien propulsion device having a right-hand propeller 31 which turns in the clockwise direction, as viewed from astern, during operation of the boat 13 in the forward direction. To reduce undesired steering torque generated by the rotating propellers 24 and 31 of the two marine propulsion devices 10 and 29, and thereby improve overall boat handling, it is desirable for the propellers 24 and 31 of the two devices 10 and 29 to rotate in opposite directions. Accordingly, the propeller 24 of the left-hand, or port device 10 is a left hand propeller which turns in the counter-clockwise direction, as viewed from astern, when the boat 13 is operated in the forward direction.

To improve manufacturing economy, it is desirable that, to the extent possible, the port and starboard marine propulsion devices 10 and 29 each utilize identical components, and, in particular, identical internal combustion engines 26 turning in the same direction. To obtain the improved handling provided by counter-rotating propellers, while maintaining the economy and simplicity of using identical components wherever possible, the counter-rotation transmission 28 in the gearcase housing 22 of the port marine propulsion device 10 is arranged to provide propeller rotation in the direction opposite to that provided by the starboard marine propulsion device 29 when both devices are set to provide thrust in the same (i.e., forward or reverse) direction.

The counter-rotation transmission 28 within the gearcase 22 of the port marine propulsion device 10 is illustrated in FIG. 3. As shown, the gearcase housing includes a hollow interior 32 having a closed forward end 33 and an open rearward end 34. One end of the drive shaft 27 extends downwardly into the interior 32 of the gearcase housing 22, and a pinion 36 is mounted on the end of the drive shaft by means of a threaded nut 37.

To rotatably support the propeller shaft 23 within the gearcase housing, the counter-rotation transmission 28 includes a propeller shaft bearing housing assembly 38 positioned within the gearcase housing 22 adjacent the open rear end. The bearing housing assembly 38 includes a propeller shaft bearing housing 38 which is generally cylindrical in form and includes an open, bell-shaped forward end 41 defining an interior or cavity, and a disc-shaped rearward end 42. A substantially circular passageway 43 is formed axially through the propeller shaft bearing housing 39, and forward and rearward bearing assemblies 44 and 46 are provided adjacent the forward and rearward ends 41 and 42 of the propeller shaft bearing housing 39 to rotatably support the propeller shaft 23 within the propeller shaft bearing housing 39. the disc-shaped rearward end 42 of the bearing housing 39 includes a plurality of openings (not shown) permitting rearward passage from the gearcase housing 22 of exhaust gases.

To locate the propeller shaft bearing housing assembly 38 within the gearcase housing 22, an annular shoulder 47 is formed within the interior 32 of the gearcase housing 22 and is positioned to engage the forwardmost end 48 of the propeller shaft bearing housing 39 and thereby limit forward travel of the propeller shaft bearing housing 39 assembly relative to the gearcase housing 22 and thereby also to transmit forward thrust from the bearing housing 39 to the gearcase housing 22. Suitable means located immediately to the rear of the propeller shaft bearing housing 39 is provided to bias the propeller shaft bearing housing assembly 38 forwardly against the shoulder 47 as well as to limit rearward movement of the propeller shaft bearing housing assembly 38 relative to the gearcase housing 22, and thus properly retain the bearing housing 39 in the gearcase housing 22, and also transmit rearward thrust from the bearing housing 39 to the gearcase 22. While various arrangements can be employed, in the illustrated construction, such means comprises a retaining arrangement 50 which is shown and described in U.S. Pat. No. 4,413,865 issued Nov. 8, 1983, and which is incorporated herein by reference. This arrangement 50 also serves to prevent rotation of the bearing housing 39 relative to the gearcase housing 22.

As further illustrated in FIG. 3, the propeller shaft 23 includes a rear end portion or section onto which the propeller is mounted, and a forward portion or section extending forwardly of the rearend portion. In the embodiment shown, the propeller shaft 23 is of split-shaft configuration and the forward portion or section comprises a forward or clutch shaft section 58, while the rear end portion or section comprises a rearward propeller shaft section 59 positioned rearwardly of, and coaxially aligned with, the clutch shaft section 58. The clutch shaft 58 and rearward propeller shafts 59 are coupled for co-rotation with each other by means of a splined recess 61 formed adjacent the forward end of the rearward shaft 59 and a splined outer surface 62, formed adjacent the rear end of the clutch shaft 58 and received in the splined recess 61.

To selectively translate rotation of the vertical drive shaft 27 into rotation of the horizontal propeller shaft 23, the counter-rotation transmission 28 further includes a pair of bevel gears 63 and 64 coaxially aligned with the propeller shaft 23 and located, respectively, forwardly and rearwardly of the pinion 36 so as to mesh with opposite sides of the pinion 36. When so positioned, the forwardly and rearwardly located bevel gears 63 and 64 rotate in opposite dirctions in response to rotation of the drive shaft 27 and the pinion 36. Accordingly, by coupling one or the other of the bevel gears 63 or 64 to the propeller shaft 23, rotation of the propeller shaft 23 in either direction can be achieved. As shown, the forwardly located bevel gear 63 is rotatably supported by means of a forwardly located bevel gear bearing housing or shifter housing 66 mounted within the gearcase housing 22 adjacent the closed forward end 33.

In the discussion which follows, the rearwardly located bevel gear 64 is sometimes referred to as a forward thrust, rearwardly located, bevel gear, or a forward thrust bevel gear.

In conventional marine propulsion devices, such as the starboard device 29 shown in FIG. 2, the forwardly located bevel gear is typically coupled to the propeller shaft during forward operation of the marine propulsion device and the boat. In such conventional marine propulsion devices, forward thrust can thus be transferred from the propeller shaft to the forwardly positioned bevel gear and from the bevel gear to the gearcase housing.

In the counter-rotation transmission of FIG. 3, rotation of the propeller shaft 23 in the counter-rotational direction is achieved by selectively coupling the rearwardly located bevel gear 64 to the propeller shaft 23 during forward operation of the marine propulsion device 10 and the boat 13.

To provide for the transfer of forwardly directed thrust from the propeller shaft 23 to the gearcase housing 22 when the propeller shaft 23 is coupled for co-rotation with the rearwardly located bevel gear 64, means are provided for transmitting forward thrust from the propeller shaft 23 to the gearcase 22 through the propeller shaft bearing housing 39. While various suitable thrust transmitting means can be used, in the illustrated construction, the thrust transmitting means includes a forward thrust, rearwardly located, bevel gear assembly 67 connected to the propeller shaft bearing housing 39 and forming a part of the propeller shaft bearing housing assembly 38.

As best seen in FIGS. 3, 5 and 6, the forward thrust rear bevel gear assembly 67 includes the forward thrust, rearwardly located, bevel gear 64 which is adapted to receive forward thrust from the propeller shaft 23 and transfer forwardly directed thrust to a thrust transferring element 68 coupled to the propeller shaft bearing housing 39. In particular, the forward thrust, rearwardly located, bevel gear 64 includes (FIG. 6) a generally cylindrical body portion 69 having forward and rear ends 71 and 72 and further includes, at the forward end 71, a bevel gear portion 73, and, at the rear end 72, a radially outwardly extending annular flange or thrust flange 74.

To receive forwardly directed thrust from the propeller shaft 23, the thrust flange 74 formed at the rear 72 of the forward thrust rear bevel gear 64 includes a substantially annular, rearwardly facing thrust receiving surface 76. To transfer forwardly directed thrust from the forward thrust rear bevel gear 64, the thrust flange 74 includes a substantially annular forwardly facing thrust transferring surface 77 located forwardly of the rearwardly facing thrust receiving surface 76. Preferably, the thrust flange 74 comprises a separate annular washer fixed to the rear 72 of the cylindrical body portion 69. Any suitable means can be employed to fix the thrust flange 74 to the rear 72 of the cylindrical body portion, such as a press fit connection, a bolted connection, or a threaded connection. In the illustrated construction, such means comprises a weld 79.

As further illustrated, the bevel gear portion 73 of the forward thrust, rearwardly located, bevel gear 64 includes a rearwardly facing annular surface 78 spaced forwardly of the forwardly facing thrust transferring surface 77 and oriented substantially perpendicularly to the generally cylindrical body portion 69.

Referring to FIGS. 3, 5, 6, 7 and 8, the thrust transferring element 68 for transferring forwardly directed thrust from the forward thrust rear bevel gear 64 to the propeller shaft bearing housing 39 preferably comprises an annular member or collar 81 encircling the cylindrical portion 69 of the forward thrust rear bevel gear 64 between the bevel gear portion 73 and the flange 74. The annular collar 81 includes a rearwardly facing annular surface 82 opposite the forwardly facing thrust transferring surface 77 of the forward thrust rear bevel gear 64 and is adapted to receive forwardly directed thrust transferred from the bevel gear 64.

The annular collar 81 is rotatable relative to the forward thrust rear bevel gear 64 and is supported for such rotation by means of forward and rear radial thrust bearing assemblies 83 and 84 disposed, respectively, between the forwardly facing annular end surface of the annular collar 81 and the rearwardly facing surface 78 of the bevel gear portion 73, and between the rearwardly facing annular surface 82 of the annular collar 81 and the forwardly facing thrust transferring surface 77 of the bevel gear 64. An additional axial bearing assembly 86 is located between the annular collar 81 and the cylindrical body portion 69 of the forward thrust rear bevel gear 64. During assembly, the annular collar 81, together with the various bearings 83, 84 and 86, are assembled around the cylindrical body portion 69 of the forward thrust rear bevel gear 64, after which the thrust flange 74 is welded or otherwise fixed to the rear 72 of the rear bevel gear 64. If desired, an axial bearing assembly (not shown) can be located between the forward thrust rear bevel gear 64 and the propeller shaft 23.

In order to transfer forwardly directed thrust from the annular collar 81 to the propeller shaft bearing housing 39, means are provided on the collar 81 and on the bearing housing 39 for transmitting such forward thrust to the bearing housing 39 for ultimate transmission to the gearcase. While various other thrust transferring means can be used, in the illustrated construction, the annular collar 81 includes a substantially cylindrical outer surface 87, and the thrust transferring means includes external threads 88 formed in the cylindrical outer surface 87 and adapted to engage complimentary internal threads 89 formed adjacent the bell-shaped forward end 41 of the propeller shaft bearing housing 39. Forwardly directed thrust transferred from the annular collar 81 to the propeller shaft bearing housing 39 is thereafter transferred from the propeller shaft bearing housing 39 to the gearcase housing 22 by means of the shoulder 47 formed in the interior of the gearcase housing 22.

In order to transfer forwardly directed thrust through the forward thrust rear bevel gear assembly 67 and propeller shaft bearing housing 39 to the gearcase housing 22, a flange 90, having a forwardly facing annular thrust transferring surface 91, is formed on the propeller shaft 23 rearwardly of the rearwardly facing thrust receiving surface 76 of the forward thrust, rearwardly located, bevel gear 64 and is adapted to engage the rearwardly facing thrust receiving surface 76 when the propeller shaft 23 is coupled for co-rotation with the forward thrust, rearwardly located, bevel gear 64. In the illustrated embodiment, the flange 90 is formed at the forward end of the rear propeller shaft section 59 and is dimensioned and positioned to contact the rearwardly facing thrust receiving surface 76 when the rear propeller shaft section 59 is biased forwardly into engagement with the forward thrust, rearwardly located, bevel gear 64 under the forward thrust developed by the propeller 24 during co-rotation of the propeller shaft 23 with the forward thrust, rearwardly located, bevel gear 64.

Suitable means are provided to facilitate assembly of the forward thrust, rearwardly located, bevel gear assembly 67 to the propeller shaft bearing housing 39. While various other suitable means can be used, in the illustrated construction, means are provided for coupling the annular collar 81 to a suitable wrench (not shown) for externally applying torque to threadedly engage the annular collar 81 with the bearing housing 39. Such means includes an outwardly extending lip 92 formed at the forward end of the annular collar 81, and a plurality of inwardly directed, diametrically opposed slots 93 (FIGS. 6, 7 and 8) formed through the lip 92 and axially along the outer surface 87 of the annular collar 81. The slots 93 are each dimensioned to be engaged by the teeth of a spanner wrench (not shown) whereby the annular collar 81 can be threaded into the forward end 41 of the propeller shaft bearing housing 39 so that only the propeller shaft bearing housing 39 engages the forward shoulder 47 of the gearcase housing 22.

As shown in FIG. 8, a plurality of axially extending slots 94, forming lubricant passageways for facilitating lubrication of the axial bearing assembly 86, are formed along the interior of the annular collar 81 and communicate with the external slots 93 through a plurality of radially directed passageways 96.

Referring to FIG. 3, means are provided for selectively coupling the propeller shaft 23 for co-rotation with one or the other of the bevel gears 63 or 64. While various suitable selective coupling means can be employed, in the illustrated embodiment the selective coupling means includes a shifter mechanism 97 having a clutch dog 98 adapted for axial sliding movement along the exterior of the clutch shaft 58 between the forwardly located and rearwardly located bevel gears 63 and 64. The clutch dog 98 is non-rotatable relative to the clutch shaft 58 and is adapted to engage and thereafter co-rotate with whichever one of the forward or rearwardly located bevel gears 63 or 64 it is moved toward.

Accordingly, when the clutch dog 98 is brought into engagement with the forwardly located bevel gear 63, the clutch dog 98, together with the clutch shaft 58 and the rear section 59 of the propeller shaft 23, rotates in the same direction as the rotation of the forwardly located bevel gear 63. Similarly, when the clutch dog 98 engages and co-rotates with the rearwardly located bevel gear 64, the propeller shaft 23 rotates in the opposite direction. When the clutch dog 98 is positioned substantially midway between the forwardly and rearwardly located bevel gears 63 and 64, such as when the marine propulsion device 10 is shifted to "neutral," the clutch dog 98 engages neither bevel gear and the propeller shaft 23 is driven in neither direction.

Control over which of the forwardly or rearwardly located bevel bears 63 and 64 is engaged by the clutch dog 98 is provided by means of the shifter mechanism 97 which further includes an elongate shift rod 99 extending downwardly into the gearcase housing 22 adjacent the closed forward end 33.

In shifter assemblies used in conventional marine propulsion devices, the marine propulsion device is shifted into "forward" drive by means of a linkage assembly which moves a clutch dog forwardly in response to upward movement of a shift rod so that the propeller shaft co-rotates with the forwardly located bevel gear. Similarly, in such conventional devices, "reverse" drive is selected by downward movement of a shift rod which causes a clutch dog to move rearwardly into engagement with the rear bevel gear.

In the counter-rotation transmission illustrated in FIG. 3, it is desirable to maintain this same, conventional relationship between the direction of movement of the shift rod 99 and the direction of thrust provided by the marine propulsion device 10. However, to provide rotation of the propeller shaft 23 in the counter-rotational direction, the shifter mechanism 97, as illustrated in FIG. 3, functions to provide rearward movement of the clutch dog 98 in response to upward movement of the shift rod 99 and forward movement of the clutch dog 98 in response to downward movement of the shift rod 99.

To achieve the desired relationship between movement of the shift rod 99 and movement of the clutch dog 98, the shifter mechanism 97 includes a rocker arm or shift lever 101 in the form of a bell crank having a rearwardly extending, substantially horizontal arm 102 and a pair of downwardly extending, substantially vertical arms 103 arranged for common pivotal movement about a horizontal pivot pin 104 supported adjacent the forward closed end 33 of the gearcase housing 22, preferably in the shifter housing 66, such that the outermost end 106 of the substantially horizontal arm 102 is positioned substantially directly vertically beneath the lowermost end of the shift rod 99, and such that the lowermost ends 107 of the substantially vertical arms 103 are at the vertical level of the horizontal axis of the propeller shaft 23. When so positioned and mounted, it will be appreciated that upward movement of the outermost end 106 of the horizontal arm 102 results in rearward movement of the lowermost ends 107 of the vertical arms 103, while downward movement of the horizontal arm 102 results in forward movement of the lowermost ends 107 of the vertical arms 103.

In order to couple the shift rod 99 to the horizontal arm 102 of the shift lever 101, the shifter mechanism 97 further includes a shift rod lower portion or shift coupler 108 which, as best shown in FIGS. 3 and 4, includes an upwardly extending portion 109 threadedly engaging the lowermost end of the main portion of the shift rod 99 and has a rectangularly sectioned slot 111 which receives the outermost end 106 of the horizontal arm 102. The outermost end 106 of the horizontal arm 102 includes an arcuate outer periphery and is closely received in the slot 111. Accordingly, vertical movement of the shift coupler 108 in response to vertical movement of the shift rod 99 causes pivotal movement of the shift lever 101 around the pivot 104. To provide clearance for the horizontal arm 102 during such vertical movement, the slot 111 is flared at its end nearest the pivot 104.

In order to provide axial movement of the clutch dog 98 in response to rotation of the shift lever about the pivot 104, an elongate, substantially horizontal, axially movable shifter shaft 112 is reciprocably received in a horizontal bore 113 formed in the forward end of the clutch shaft 58 coaxially with the rotational axis thereof. A vertical coupling pin 114 extends through the rearward end of the shifter shaft 113, through a pair of diametrically opposed slots 116 and 117 formed in the clutch shaft 58, and into a pair of aligned apertures 118 and 119 formed in the clutch dog 98 so that axial movement of the shifter shaft 112 results in axial movement of the clutch dog 98 relative to the clutch shaft 58. The forward end of the shifter shaft 112 extends axially through the forward bevel gear bearing housing 66, and terminates adjacent the lowermost ends 107 of the vertical arms 103 of the shift lever 101. A shift cradle 121 is mounted to the forwardmost end of the shifter shaft 112 and is coupled to the lowermost ends 107 of the vertical shift lever arms 103 so that pivotal movement of the shift lever 101 results in axial movement of the shifter shaft 112. Preferably, the shift cradle 121 is rotatable relative to the shifter shaft 112 so that no rotational movement occurs between the shift cradle 121 and the vertical arms 103 of the shift lever.

In operation, upward movement of the shift rod 99 causes counter-clockwise movement of the shift lever 101 as viewed in FIG. 3. As a result, the clutch dog 98 is driven rearwardly into engagement with the rearwardly located bevel gear 64. Similarly, downward movement of the shift rod 99 causes clockwise movement of the shift lever 101 as viewed in FIG. 3, with the further result that the clutch dog 98 is driven forwardly into engagement with the forwardly located bevel gear 63.

As best seen in FIG. 4, the shift coupler 108 is supported for vertical reciprocative movement by means of a downwardly extending detent shaft 122 which is received in a substantially vertical bore 123 formed in the forward bevel gear bearing or shifter housing 66. In order to avoid interference with the horizontal shifter shaft 112, the detent shaft 122 is laterally offset from the upwardly extending portion 109 of the shift coupler 108.

In order to provide a positive detent for maintaining the shifter mechanism 97 in the "neutral" position, wherein the clutch dog 98 engages neither the forwardly located or the rearwardly located bevel gear 63 or 64, a detent mechanism is provided. As best shown in FIG. 4, the detent mechanism includes a horizontal, closed-ended bore 124 formed in the forward bevel gear bearing housing or shifter housing 66 and a tapered notch 126 formed in the downwardly extending detent shaft 122 along the side facing the shifter shaft 112. A detent ball 127 and bias spring 128 are disposed within the horizontal bore 124 between the closed end of the bore and the detent shaft 122 as illustrated. When the notch 126 is brought into alignment with the detent ball 127, the detent ball 127 is partially received in the notch 126 to help maintain the vertical position of the detent shaft 122 and thereby provide a distinct detent indication. Preferably, the location of the notch 126 is such that the detent ball 127 is received in the notch 126 when the shift rod 99 is in the "neutral" position.

When the shifter mechanism 97 is operated such that the clutch dog 98 engages the forwardly located bevel gear 63, the propeller shaft rotation is such that reverse thrust is developed by the propeller 24 and transmitted through the propeller shaft 23. In order to transmit the reverse thrust thus developed to the gearcase housing 22, the flange 90 formed at the forward end of the rear propeller shaft section 59 includes an annular, rearwardly facing, thrust transferring surface 129 which is located opposite an annular, forwardly facing, thrust receiving surface 131 formed in the propeller shaft bearing housing 39 rearwardly of the flange 91. A thrust bearing 132 is disposed between the rearwardly facing thrust transferring surface 129 and the forwardly facing thrust receiving surface 131 and functions to transmit reverse thrust from the propeller shaft 23 to the propeller shaft bearing housing 39. From the propeller shaft bearing housing 39, the reverse thrust is transferred through the retaining arrangement 50 to the gearcase housing 22.

When the propeller shaft 23 is coupled for rotation with the rearwardly located bevel gear 64, no relative rotational movement occurs between the forwardly facing thrust transferring surface 91 and the rearwardly facing thrust receiving surface 76. However, during reverse operation, when the propeller shaft 23 is coupled for co-rotation with the forwardly located bevel gear 63, the forwardly facing thrust transferring surface 91 and the rearwardly facing thrust receiving surfaces 76 rotate in opposite directions at a relative rotational rate of twice that of either element alone. In order to avoid excessive wear under such conditions, the propeller shaft 23 and the propeller shaft bearing housing assembly 38 are preferably constructed so that some end-play exists between the rear portion 59 of the propeller shaft 23 and the forward thrust rear bevel gear assembly 67. Thus, when developing reverse thrust, the rearward section 59 will move slightly rearwardly to provide a clearance 52 between the surfaces 76 and 91.

Means are also provided for maintaining the forward and rearward sections 58 and 59 of the propeller shaft 23 in predetermined axial relation in order to avoid forward displacement of the forward shaft section 58 relative to the rearward shaft section 59 incident to forward thrust acceleration and thereby to insure maintainance of a clearance 53 between the forward bevel gear 63 and a flange 55 on the forward shaft section 58. While various constructions can be employed, in the construction illustrated in FIG. 3, a partially compressed coil spring 133 is disposed between the rearward end of the shifter shaft 113 and the clutch or forward shaft section 58. The shifter shaft 113 is normally held stationary, in the absence of operator activity, by the shift control linkage which normally includes a single lever control (not shown). This spring 133 has the effect of continuously biasing the clutch shaft or forward shaft section 58 rearwardly and assures that the clutch shaft 58 will follow and will have common movement with the rear propeller shaft section 59, and thereby avoid transfer of forward thrust forces to the clutch shaft 58, rather than to the forward thrust, rearwardly located, bevel gear assembly 67. Such maintenance of the predetermined axial relation of the shaft sections 58 and 59 also insures the presence of the clearance 53 when shifting to, and operating in, forward drive.

Shown in FIG. 9 is another arrangement for preventing undesirable forward movement of the forward shaft section 58 relative to the rearward shaft section 59 in response to increasing forward thrust, either in response to shifting from neutral or while in the forward drive condition. More particularly, the arrangement shown in FIG. 6 is essentially identical to that shown in FIG. 3 except that the spring 133 is omitted, and except that other releasable means are provided for retaining the forward shaft section 58 and the rearward shaft section 59 in predetermined axial relation to each other.

Still more specifically, the construction shown on FIG. 9 differs from that shown in FIG. 3 by the provision of a counter bore 201 which extends rearwardly in the rearward shaft section 59 from the recess 61, and by a reduced diameter shaft portion 203 which extends rearwardly from the splined portion 62 of the forward shaft section 58, and which is received in the counter bore 201 in the rearward shaft section 59. As indicated, the arrangement shown in FIG. 9 includes means for retaining the forward shaft section 58 and the rearward shaft section 59 in a predetermined axial relation to each other. While various arrangements can be employed, in the construction illustrated in FIG. 9, such means comprises a blind bore 205 which extends forwardly from the rear of the shaft portion 203 and which defines a sleeve 207, together with a cross bore 211 in the sleeve 207, an annular groove 209 in the wall of the counter bore 201 in axial alignment with the cross bore 211, a pair of locking balls 213 respectively located in the spaced segments of the cross bore 211, and means for resiliently outwardly biasing a portion of the locking balls 213 into the annular groove 209 to releasably hold the forward and rearward shaft sections 58 and 59 in predetermined axial relation to each other.

While other constructions can be employed, in the construction illustrated in Figure 9, such means for biasing outwardly the locking balls 213 includes a third ball 215 located in the bore 205 forwardly of the locking balls 213 and bearing against the locking balls 213, together with a biasing spring 231 which, at one end, bears against the third ball 215, and at the other end, bears against the blind forward end of the bore 205.

Thus in the construction shown in FIG. 9, and in the absence of a force sufficiently large to overcome the action of the spring 231, both shaft sections 58 and 59 will be retained in predetermined axial relation to each other, notwithstanding limited forward and rearward movement of the rearward shaft section 59 in response to thrust conditions.

It will be appreciated that during operation, forward thrust is transferred from the flange 90 of the rear propeller shaft portion or section 59 to the rearwardly facing thrust receiving surface 76 of the forward thrust rear bevel gear assembly 67. Thrust is then transferred from the rearwardly located thrust flange 74 of the forward thrust rear bevel gear 64, through the annular thrust transferring member or collar 81, to the propeller shaft bearing housing 39. From the propeller shaft bearing housing 39, the forwardly directed thrust is transferred to the gearcase housing 22. While receipt of the bevel gear assembly 67 into the bearing housing 39 and fixed retention of the bearing housing 39 in the gearcase housing 22 serve to properly locate and support the bevel gear 64 in meshing engagement with the drive pinion 36 and to prevent cocking from coaxial alignment with the propeller shaft 23, transmission of forwardly directed thrust to the forward thrust, rearwardly located, bevel gear 64, assists in retaining the bevel gear 64 in proper meshing engagement with the pinion 37. In addition, because forward thrust is applied to the forward thrust, rearwardly located, bevel gear 64 uniformly around the rearwardly located thrust flange 74, any residual tendency for the forward thrust, rearwardly located, bevel gear 64 to cock under the influence of the torque transmitted by the pinion 37 is also reduced and wear between the forward thrust, rearwardly located, bevel gear 64 and the propeller shaft 23 and between the bevel gear 64 and the collar 81 is also reduced.

Various other features and advantages of the invention are set forth in the following claims.

We claim:

1. A bevel gear assembly comprising a bevel gear including a generally cylindrical body portion having a first end and a second end, said bevel gear also including a bevel gear portion fixedly extending from said first end of said cylindrical body portion and an annular flange fixedly extending from said second end of said cylindrical body portion and in spaced relation to said bevel gear portion to define an annular cavity between said annular flange and said bevel gear portion, and a substantially annular member encircling said cylindrical body portion and located in said annular cavity between said bevel gear portion and said annular flange and being rotatable relative to said bevel gear, and respective mutually facing thrust transmitting surfaces on said annular member and said annular flange.

2. A bevel gear assembly in accordance with claim 1 wherein said member is adapted to be positioned adjacent a surrounding exterior structure and said member includes thrust transferring means for transferring forwardly directed thrust from said member to the adjacent surrounding exterior structure.

3. A bevel gear assembly comprising a bevel gear including a generally cylindrical body portion having a first end and second end, said bevel gear also including a bevel gear portion at said first end and an annular flange at said second end and including a forwardly facing bearing surface for transferring forwardly directed thrust from said annular flange, and further comprising a substantially annular member encircling said cylindrical body portion between said bevel gear portion and said annular flange and permitting rotation of said bevel gear relative to said annular member, said annular member including a rearwardly facing bearing surface for receiving forwardly directed thrust from said annular flange, and a substantially cylindrical outer surface, and said annular member being adapted to be positioned adjacent a surrounding exterior structure and including thrust transferring means for transferring forwardly directed thrust from said member to the adjacent surrounding exterior structure and comprising threads formed in said cylindrical outer surface.

4. A bevel gear assembly in accordance with claim 3 and also including a thrust bearing disposed between said forwardly and rearwardly facing thrust bearing surfaces.

5. A bevel gear assembly in accordance with claim 4 and also including a bearing between said member and said cylindrical body portion for facilitating rotation of said bevel gear relative to said member.

6. A bevel gear assembly in accordance with claim 5 wherein said member includes a forward end adjacent said bevel gear portion, and further including a bearing disposed between said forward end of said member and said bevel gear portion.

7. A bearing assembly for use in a marine propulsion device, said bearing assembly comprising a bevel gear including a generally cylindrical body portion having a first end and a second end, said bevel gear also including a bevel gear portion adjacent said first end and an annular flange adjacent said second end, a substantially annular collar encircling said cylindrical body portion between said bevel gear portion and said annular flange and adapted to permit rotation of said bevel gear relative to said annular collar, a bearing housing having a forward end including a cavity dimensioned to receive therein said annular collar and said annular flange, and thrust transfer means for transferring forwardly directed thrust from said annular collar to said forward end of said bearing housing.

8. A bearing housing assembly in accordance with claim 7 wherein said annular flange includes a forwardly facing thrust bearing surface for transferring forwardly directed thrust from said annular flange to said annular collar and wherein said annular collar includes a rearwardly facing thrust bearing surface for receiving the forwardly directed thrust transferred from said annular flange.

9. A bearing housing assembly in accordance with claim 8 wherein said annular collar is secured to said forward end of said bearing housing.

10. A bearing housing assembly in accordance with claim 8 wherein said annular collar threadedly engages said forward end of said bearing housing.

11. A bearing housing assembly in accordance with claim 8 wherein said annular collar includes means for receiving an externally applied torque operating to threadedly engage said annular collar with said bearing housing.

12. A bearing housing assembly in accordance with claim 11 wherein said annular collar includes a forward flange opposite said rearwardly facing thrust bearing surface and said torque receiving means comprises a pair of diametrically opposed slots formed in said forward flange.

13. A bearing assembly for use in a marine propulsion device, said bearing assembly comprising a bevel gear including a generally cylindrical body portion having a first end and a second end, said bevel gear also including a bevel gear portion adjacent said first end and including a radially extending bearing surface facing toward said second end, and said bevel gear also including an annular flange adjacent said second end and including a radially extending bearing surface facing toward said first end, a substantially annular member encircling said cylindrical body portion between said bevel gear portion and said annular flange and adapted to permit rotation of said bevel gear relative to said annular member, said annular member including end bearing faces in facing relation to said bearing surface of said bevel gear, and an inner bearing surface in telescopic relation to said cylindrical portion, bearings between said end bearing faces and said bearing surfaces, an other bearing between said inner bearing surface and said cylindrical portion, and a bearing housing having a forward end including a cavity dimensioned to receive therein said annular member and said annular flange.

14. A marine propulsion device comprising a lower unit gear case, a propeller shaft section rotatably supported in said lower unit gearcase, a propeller supported on said propeller shaft section, a forward shaft section supported in said lower unit gear case for rotation in co-axial relation to and forwardly of said propeller shaft section, means connecting said forward shaft section and said propeller shaft section for common rotation, and means on said forward shaft section and on said propeller shaft section for releasably retaining said forward shaft section in predetermined axial relation to said propeller shaft section.

15. A marine propulsion device in accordance with claim 14 wherein said means connecting said forwrad shaft section and said propeller shaft section for common rotation comprises a first axial bore located in one of said shaft sections and having therein an annular groove, and a portion projecting from the other of said shaft sections and received in said first bore, and wherein said retaining means comprises a second axial bore located in said other shaft section and having an open end adjacent said one shaft section and a closed other end, said second bore defining a sleeve, a cross bore in said sleeve in axial alignment with said annular groove, a ball located in said cross bore in said sleeve, and means in said second axial bore for releasably biasing a portion of said ball into said annular groove.

16. A marine propulsion device in accordance with claim 15 wherein said means for releasably biasing a portion of said ball into said annular groove includes an other ball in said second axial bore inwardly of said first mentioned ball and a spring located in said second axial bore and bearing against said other end and said other ball.

17. A marine propulsion device comprising a lower unit gear case, a propeller shaft section rotatably supported in said lower unit gearcase and being axially movable through a limited range, a propeller supported on said propeller shaft section, a forward shaft section supported in said lower unit gear case for rotation in co-axial relation to and forwardly of said propeller shaft section, means connecting said forward shaft section and said propeller shaft section for common rotation, and means releasably retaining said forward shaft section in predetermined axial relation to said propeller shaft section.

18. A marine propulsion device comprising a lower unit gear case, a propeller shaft section rotatably supported in said lower unit gearcase, a propeller supported on said propeller shaft section, a forward shaft section supported in said lower unit gear case for rotation in co-axial relation to and forwardly of said propeller shaft section, means connecting said forward shaft section and said propeller shaft section for common rotation, and means releasably retaining said forward shaft section in predetermined axial relation to said propeller shaft section and comprising, a bore located in said forward shaft section and having a forward open end and a rearward closed end, a member in said bore, and a spring located in said bore and having a first end bearing against said closed end of said bore and a second end bearing against said member.

19. A marine propulsion device in accordance with claim 18 wherein said member is a shifter shaft, and means for selectively displacing said shifter shaft in said bore between a neutral position and a drive position.

20. A marine propulsion device comprising a lower unit including a gearcase, a propeller shaft bearing housing located within said gearcase, a propeller shaft rotatably mounted in said propeller shaft bearing housing, and means for transmitting forward thrust from said propeller shaft to said gearcase through said propeller shaft bearing housing.

21. A marine propulsion device in accordance with claim 20 wherein said marine propulsion device further comprises a rear bevel gear adjacent said propeller shaft bearing housing, and wherein said thrust transmitting means transmits forward thrust from said propeller shaft to said rear bevel gear and from said rear bevel gear to said propeller shaft bearing housing.

22. A marine propulsion device in accordance with claim 21 wherein said thrust transmitting means include a thrust transmitting element mounted on said propeller shaft bearing housing and engageable with said rear bevel gear.

23. A marine propulsion device in accordance with claim 20 wherein said propeller shaft comprises a plurality of separable members coupled for co-rotation with one another.

24. A marine propulsion device comprising a lower unit including a gearcase having a forwardly located end and a rearwardly located end, a rotatable pinion located within said gearcase, a propeller shaft rotatably mounted within said gearcase, a rearwardly located gear located in coaxial relation to said propeller shaft and in meshing engagement with said pinion and including a fixedly extending flange having a rearward surface selectively engagable with said propeller shaft, and a forward surface in generally parallel relation so said rearward surface for transmitting forward thrust from said propeller shaft to said gearcase.

25. A bevel gear comprising a generally cylindrical body portion having a forward end and a rearward end, a bevel gear portion located at said forward end, and a radially outwardly extending flange formed at said rearward end, said flange including a substantially annular rearwardly facing thrust receiving surface, a substantially annular forwardly facing thrust transferring surface located forwardly of said rearwardly facing thrust receiving surface and extending in generally parallel relation thereto.

26. A bevel gear in accordance with claim 25 wherein said bevel gear portion includes a rearwardly facing annular surface spaced forwardly of said forwardly facing thrust transferring surface and oriented substantially perpendicularly to said generally cylindrical body portion.

27. A marine propulsion device comprising a lower unit including a gearcase, a driveshaft having an end extending into said gearcase, a pinion mounted on said end of said driveshaft, a propeller shaft bearing housing located within said gearcase and having a forward end adjacent said pinion, a propeller shaft rotatably mounted in said propeller shaft bearing housing and having a rear end portion and a portion forwardly of said rear end portion, a propeller mounted on said rear end portion of said propeller shaft, a bevel gear adjacent said forward end of said propeller shaft bearing housing and engaging said pinion, said bevel gear including an annular forwardly facing thrust transferring surface, and an annular thrust transferring element mounted on said propeller shaft bearing housing and engageable with said annular forwardly facing thrust transferring surface so as to transfer thrust forwardly from said bevel gear through said thrust transferring element and to said propeller shaft bearing housing.

28. A marine propulsion device in accordance with claim 27 wherein said bevel gear includes a substantially cylindrical body portion and a substantially annular thrust flange extending radially outwardly from said body portion, said thrust flange including an annular face forming said forwardly facing thrust transferring surface.

29. A marine propulsion device in accordance with claim 28 wherein said thrust transferring element comprises an annular collar encircling said body portion of said bevel gear forwardly of said thrust flange and including a rearwardly facing annular surface opposite said forwardly facing thrust transferring surface and adapted to receive thrust transferred from said bevel gear.

30. A marine propulsion device in accordance with claim 29 wherein said annular collar is externally threaded and threadedly engages said propeller shaft bearing housing adjacent said forward end of said propeller shaft bearing housing.

31. A marine propulsion device in accordance with claim 30 wherein said annular collar includes means for receiving an externally applied torque operating to threadedly engage said annular collar with said propeller shaft bearing housing.

32. A marine propulsion device in accordance with claim 31 wherein said annular collar includes a forward flange opposite said rearwardly facing annular surface and said torque receiving means comprises a pair of diametrically opposed slots formed in said forward flange.

33. A marine propulsion device comprising a lower unit including a gearcase, a driveshaft having an end extending into said gearcase, a pinion mounted on said end of said driveshaft, a propeller shaft bearing housing located within said gearcase and having a forward end adjacent said pinion, a propeller shaft rotatably mounted in said propeller shaft bearing housing and having a flange for transmitting forward thrust, a propeller mounted on said propeller shaft, a bevel gear adjacent said forward end of said propeller shaft bearing housing and in meshing engagement with said pinion, said bevel gear including a fixedly extending flange having an annular rearwardly facing thrust receiving surface engageable with said propeller shaft flange for receiving forward thrust therefrom, and an annular forwardly facing thrust transferring surface extending parallel to said rearwardly facing surface for transmitting forward thrust to said lower unit.

34. A marine propulsion device comprising a lower unit including a gearcase, a drive shaft having an end extending into said gearcase, a pinion mounted on said end of said drive shaft, a propeller shaft bearing housing located within said gearcase and having a forward end adjacent said pinion, a propeller shaft rotatably mounted in said propeller shaft bearing housing and having a rear end portion and a portion forwardly of said rear end portion and further having a flange between said rear end portion and said forward portion, a bevel gear adjacent said forward end of said propeller shaft bearing housing and engaging said pinion, said bevel gear including a cylindrical portion, a forwardly located bevel gear portion extending radially outwardly from said cylindrical portion, and a rearwardly located flange extending radially outwardly from said cylindrical portion and in spaced relation to said bevel gear portion axially of said propeller shaft to define an annular pocket between said bevel gear flange and said bevel gear portion, said bevel gear flange receiving thrust from said propeller shaft flange, and an annular member located in said pocket and receiving forward thrust from said bevel gear flange.

35. A marine propulsion device in accordance with claim 34 wherein said propeller shaft flange includes a forwardly facing thrust transferring surface and said rearwardly located flange includes a rearwardly facing thrust transferring surface adapted to engage said forwardly facing thrust transferring surface.

36. A marine propulsion device in accordance with claim 35 wherein said propeller shaft flange further includes a rearwardly facing thrust transferring surface and said propeller shaft bearing housing includes a forwardly facing thrust transferring surface adapted to receive thrust from said rearwardly facing thrust transferring surface of said forwardly facing flange.

37. A marine propulsion device in accordance with claim 36 wherein said forward portion and said rear end portion of said propeller shaft are separate members, and wherein said propeller shaft further includes means for coupling said rear end portion to said forward portion for co-rotation with said forward portion.

38. A marine propulsion device in accordance with claim 37 wherein said propeller shaft flange is formed on said rear end portion.

39. A marine propulsion device comprising a lower unit including a gearcase, a drive shaft having an end extending into said gearcase, a pinion mounted on said end of said drive shaft, a propeller shaft bearing housing located within said gearcase and having a forward end adjacent said pinion, a propeller shaft rotatably mounted in said propeller shaft bearing housing and including a rear end portion, a portion forwardly of said rear end portion, and a flange on said rear end portion adjacent said forward portion, a bevel gear adjacent said forward end of said propeller shaft bearing housing and engaging said pinion, said bevel gear including a cylindrical portion and a rearwardly located flange extending radially outwardly from said cylindrical portion, said rearwardly located flange including a rearwardly facing surface engageable with said flange of said propeller shaft and including a forwardly facing thrust transferring surface, and an annular thrust transferring element mounted on said propeller shaft bearing housing and adapted to receive thrust from said annular forwardly facing thrust transferring surface and to transfer thrust forwardly from said flange of said propeller shaft through said bevel gear and said annular thrust transferring element to said propeller shaft bearing housing.

40. A marine propulsion device in accordance with claim 39 wherein said thrust transferring element comprises an annular collar encircling said cylindrical portion of said bevel gear forwardly of said rearwardly located flange, said collar including a rearwardly facing annular surface located opposite said forwardly facing thrust transferring surface and adapted to receive thrust from said bevel gear.

41. A marine propulsion device in accordance with claim 40 wherein said annular collar is externally threaded and threadedly engages said propeller shaft bearing housing adjacent said forward end of said propeller shaft bearing housing.

42. A marine propulsion device in accordance with claim 41 wherein said annular collar includes means for receiving an externally applied torque operating to threadedly engage said annular collar with said propeller shaft bearing housing.

43. A marine propulsion device in accordance with claim 42 wherein said annular collar includes a forward flange opposite said rearwardly facing annular surface and said torque receiving means comprises a pair of diametrically opposed slots formed in said flange.

44. A marine propulsion device in accordance with claim 39 wherein said forward portion and said rear end portion of said propeller shaft comprise separate members and wherein said propeller shaft further includes means for coupling said rear end portion to said forward portion for co-rotation with said forward portion.

45. A marine propulsion device comprising a lower unit including a gearcase, a drive shaft having an end extending into said gearcase, a pinion mounted on said end of said drive shaft, a propeller shaft bearing housing located within said gearcase and having a foward end adjacent said pinion, means for transferring forward thrust from said propeller shaft bearing housing to said gearcase, a propeller shaft rotatably mounted in said propeller shaft bearing housing and including a rear end portion, a portion forwardly of said rear end portion, and a flange on said rear end portion adjacent said forward portion, a propeller mounted on said rear end portion of said propeller shaft, a bevel gear adjacent said forward end of said propeller shaft bearing housing and engaging said pinion, said bevel gear including a cylindrical portion and a rearwardly located flange extending radially outwardly from said cylindrical portion, said rearwardly located flange including a rearwardly facing surface engageable with said flange of said propeller shaft and including an annular forwardly facing thrust transferring surface, and an annular thrust transferring element mounted on said propeller shaft bearing housing and engageable with said annular forwardly facing thrust transferring surface so as to transfer thrust forwardly from said propeller shaft through said bevel gear, said annular thrust transferring element, and said propeller shaft bearing housing to said gearcase.

46. A marine propulsion device in accordance with claim 45 wherein said means for transferring forward thrust from said propeller shaft bearing housing to said gearcase includes a shoulder formed in said gearcase forwardly of said propeller shaft bearing housing and engaging said forward end of said propeller shaft bearing housing.

47. A marine propulsion device comprising a lower unit including, at the bottom thereof, a gear case, a power transmitting shaft supported in said gear case for rotation about a horizontal axis and including therein an axial bore having a forwardly located open end, a bearing housing supported in said gear case and having a central aperture generally co-axial with said horizontal axis and having a vertical passage located in laterally spaced relation to said horizontal axis, a shifter shaft located in said bore, extending forwardly of said bearing housing, and being movable axially in said bore between a neutral position and a drive position, a shift rod supported by said lower unit for vertical movement therein and including a main portion in generally coplanar relation to said horizontal axis and having a lower end, said shift rod also including a lower portion having a horizontal leg fixed to said lower end of said main portion and a vertical leg extending in laterally spaced relation to said horizontal axis and with a lower end received in said passage in said bearing housing, a bell crank supported in said lower unit for pivotal movement about a horizontal axis located forwardly of said shift rod and above said horizontal axis and including a rearwardly projecting arm and a downwardly projecting arm, means connecting said downwardly projecting arm and said shifter shaft at a location forwardly of said bearing housing for affording rotation of said shifter shaft relative to said bell crank and for axially moving said shifter shaft in response to pivotal movement of said bell crank, and means connecting said rearwardly projecting arm of said bell crank with said shift rod for effecting pivotal movement of said bell crank in response to vertical movement of said shift rod.

* * * * *